US007950249B1

(12) United States Patent
White et al.

(10) Patent No.: US 7,950,249 B1
(45) Date of Patent: May 31, 2011

(54) ICE CUBES COOLED CONTAINER

(76) Inventors: Robert J. White, Lake Worth, FL (US); Richard W. White, Lake Worth, FL (US)

( * ) Notice: Subject to any disclaimer, the term of this patent is extended or adjusted under 35 U.S.C. 154(b) by 1605 days.

(21) Appl. No.: 11/238,761

(22) Filed: Sep. 29, 2005

(51) Int. Cl.
*F25D 3/02* (2006.01)

(52) U.S. Cl. ..... 62/464; 62/457.1; 62/457.7; 62/459; 62/463

(58) Field of Classification Search ..... 62/457.1, 62/457.7, 463, 464, 459
See application file for complete search history.

(56) References Cited

U.S. PATENT DOCUMENTS

| | | | | | |
|---|---|---|---|---|---|
| 1,019,631 | A * | 3/1912 | Gruendler | 62/464 |
| 1,998,681 | A | 4/1935 | Littleford | |
| 3,255,607 | A | 6/1966 | Bair | |
| 3,406,532 | A | 10/1968 | Rownd | |
| 4,213,310 | A | 7/1980 | Buss | |
| 4,798,173 | A * | 1/1989 | Wilgren | 119/61.52 |
| 4,910,975 | A * | 3/1990 | Derby | 62/372 |
| 5,671,611 | A * | 9/1997 | Quigley | 62/457.7 |
| 6,058,523 | A * | 5/2000 | Sleboda | 4/619 |
| 6,574,983 | B2 * | 6/2003 | Smith et al. | 62/372 |
| 6,601,403 | B1 | 8/2003 | Roth | |
| 6,761,041 | B2 | 7/2004 | Roth | |
| 6,763,678 | B2 * | 7/2004 | Harper | 62/461 |
| 6,763,959 | B2 * | 7/2004 | Tedder | 211/188 |
| 6,843,062 | B2 | 1/2005 | Crete | |
| 2003/0167788 | A1 * | 9/2003 | Gonzalez et al. | 62/457.1 |
| 2003/0230110 | A1 | 12/2003 | Linberg | |

* cited by examiner

*Primary Examiner* — Frantz F Jules
*Assistant Examiner* — Azim Rahim
(74) *Attorney, Agent, or Firm* — Alvin S. Blum

(57) ABSTRACT

A portable insulated cooler has a bottom space adapted to hold ice cubes. A removable perforated panel suspended over the bottom space separates the bottom space from a central cooled storage area. A removable frame suspended above the central cooled areas holds ice cube containing flasks. Each flask has a large closable opening in its upper broad flat face to easily receive ice cubes. The lower broad face of the flask forms a cooling upper margin of the central cooled area so that the contents of the area are cooled from both top and bottom. The flasks have a flange around the upper face to rest upon the frame, while most of the flask is below the frame. This enables the insulated cooler top to close. By cooling from both top and bottom, the central area is more uniformly cooled. Opening the cooler top to access the central area creates less heat gain than with prior art devices.

4 Claims, 3 Drawing Sheets

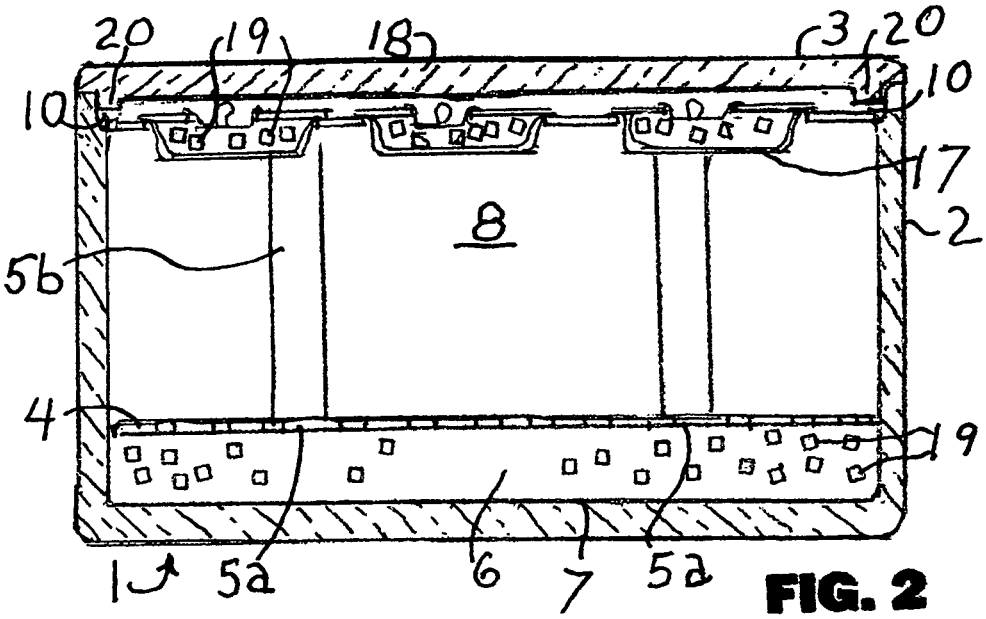
FIG. 2
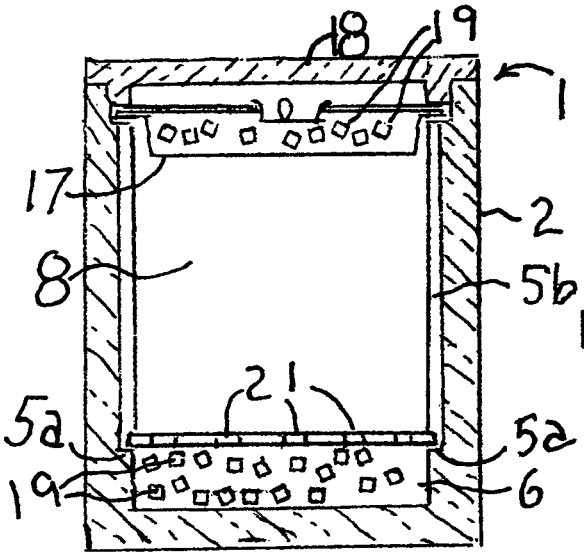
FIG. 3
FIG.4
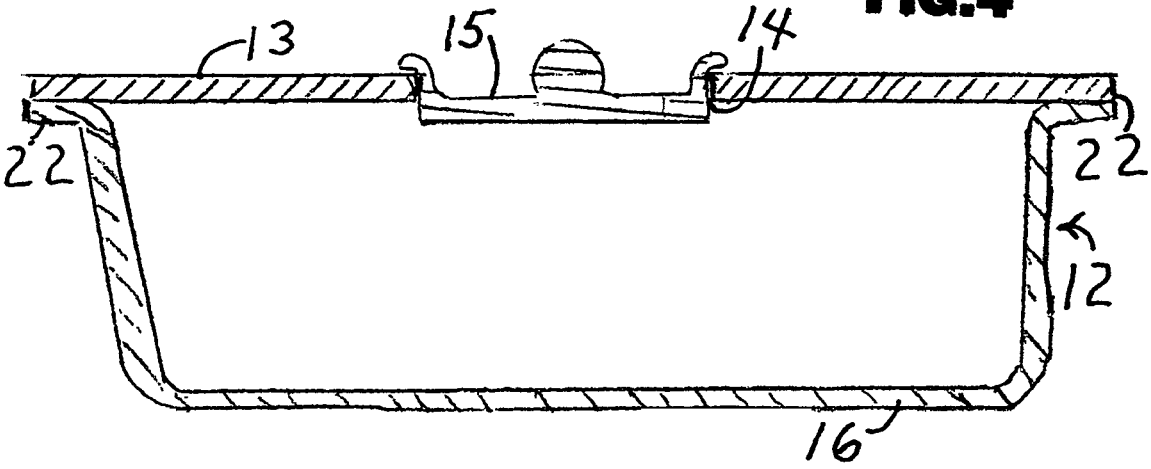

ICE CUBES COOLED CONTAINER

BACKGROUND OF THE INVENTION

This invention relates to portable insulated containers, and more particularly to a cooler whose contents are cooled by ice cubes above and below the items to be cooled. Portable insulated containers are used to keep foods and beverages cool. Ice cubes are often readily available at motels and home refrigerators. It is common practice to put ice cubes into a cooler with beverage containers. Some food items may spoil if not maintained at low temperature. If they are kept in the ice cubes they may be damaged by the melting ice. It is common practice to place a perforated barrier atop the ice cubes to keep the food items on the barrier away from the melting ice, while the water from the melting ice remains on the bottom of the cooler. However, only the bottom layer of the food items is exposed to the coldest temperature of the ice. The food items in the upper layers are insulated from the ice temperature by the intervening layers of food. Although the lid of the container is insulated, its inner surface will gradually warm up. Dangerous food storage conditions can be reached in the upper layers of food after a period of time even when the ice in the bottom of the cooler has not been exhausted. U.S. Pat. No. 4,024,731 issued May 24, 1977 to Branscum teaches thermal energy storage containers whose contents may be repeatedly frozen and held in the lid of the container. They cool the contents of the container only from the top. They make the top very heavy when opened. They are not convenient for use with ice cubes because they have a small opening to prevent leaking in the freezer. Once thawed, they must be refrozen before reuse.

SUMMARY OF THE INVENTION

It is accordingly an object of the invention to provide a portable cooler in which items such as food may be kept safe at all levels by the use of ice cubes. The invention provides for an insulated container with an insulated top that is easily opened and closed. The container has a bottom space for ice cubes, a middle space for storage of temperature sensitive materials, and a top space for ice cubes. The middle space is held free of the water of the melting ice cubes, while being cooled from top and bottom by the ice cubes. The ice cubes are readily replaced to maintain the temperature of the middle space. Access to the middle space is easily maintained. A removable perforated panel covers the bottom space while providing cooling to the middle space. A removable frame supported by the container is at the top of the middle space. The frame has a large central aperture to receive therein at least one large, flat flask. Each flask has two broad opposed faces. One of the broad faces has a large closable opening to receive ice cubes. A flange around the flask is constructed to engage the frame to hold the flask in the central aperture with the opening away from the middle space. The melting ice cubes in the flask keep the bottom broad face of the flask at a low temperature. That face forms the top of the middle space. The middle space and the items stored therein are thus exposed top and bottom to the low temperature. The at least one flask is easily moved aside to gain access to the items in the middle space.

These and other objects, features, and advantages of the invention will become more apparent when the detailed description is studied in conjunction with the drawings, in which like elements are designated by like reference characters in the various drawing figures.

BRIEF DESCRIPTION OF THE DRAWINGS

FIG. 2 is a sectional view through line 2-2 of FIG. 1 with cover closed.

FIG. 3 is a sectional view through line 3-3 of FIG. 1 with cover closed.

FIG. 4 is a sectional view the flask of the invention.

DETAILED DESCRIPTION OF PREFERRED EMBODIMENTS

Figure 1:
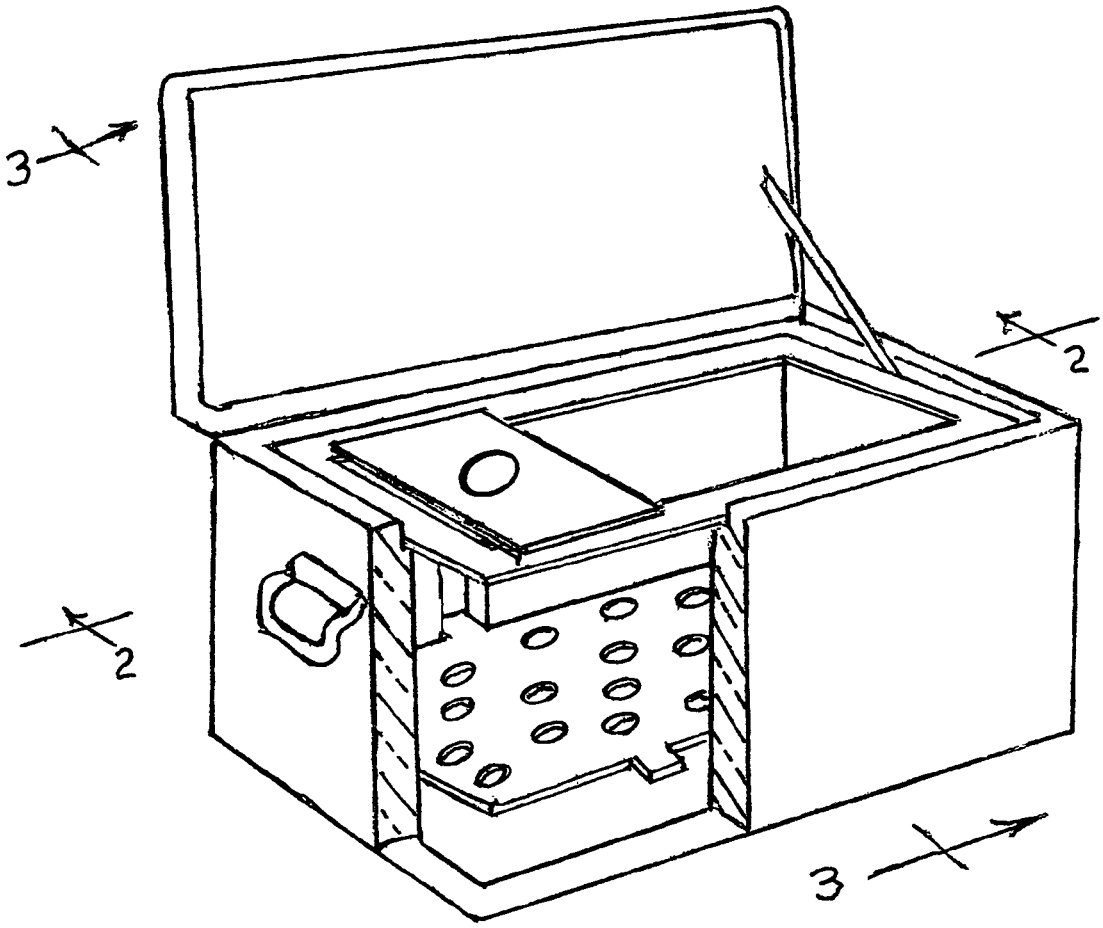
FIG. 1 is a partially cut away perspective view of the cooler with the top open.

A structure 1 for sustained cooling of contents in a storage area 8 is cooled by ice cubes 19 above and below the storage area. An insulated cooler of the type well known in the art is comprised of an insulated open top body portion 2 with an insulated cover 3 that is constructed to close the open top securely. Recess 10 extending all the way around the upper edge of body portion 2 receives a projection 20 on the perimeter of the cover to enhance the cover sealing. Panel 4 with multiple perforations 21 is removably supported by projections 5 that rest upon the bottoms 5*a* of slots 5*b* in the interior wall of the body portion. This suspends the panel 4 above the bottom 7 of the cooler to provide a bottom space 6 that can be filled with ice cubes. The perforations 21 enable the ice cubes to cool the space 8 from below, while keeping the space 8 free from the melting ice, while water from the melting ice remains in the bottom of the body portion. Other means well known in the art such as legs on the panel (not shown) may be employed to suspend the panel above the bottom of the cooler, as desired.

Figure 5:
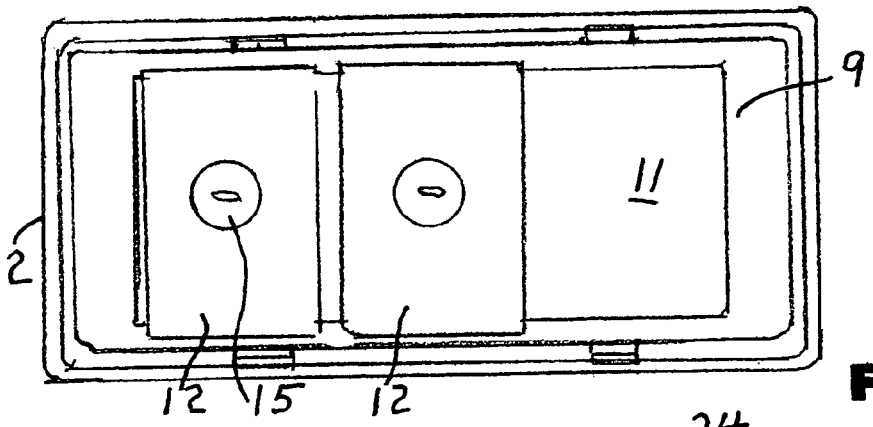
FIG. 5 is a top view of the open cooler with cover removed.
Figure 6:
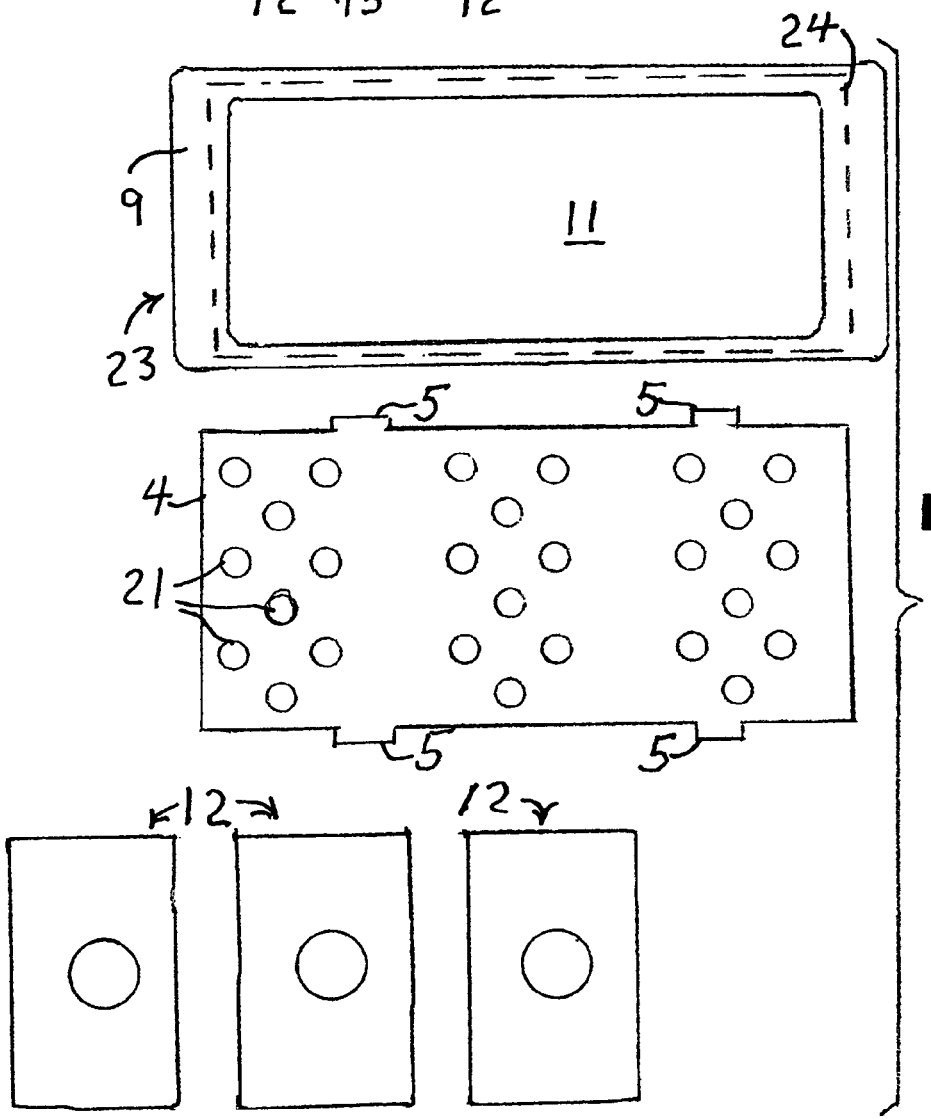
FIG. 6 is an exploded view of the apparatus of the invention to retrofit an existing cooler.

A removable frame member 9 is supported at the top of the cooler body by resting in the recess 10, where it does not interfere with the cover closing. Frame member 9 has a large central aperture 11 for the support of cooling flasks 12 filled with ice cubes that cool the storage space 8 from above. Each flask has a first broad face 13 with a large aperture 14 to easily fill with ice cubes and a second opposed broad face 16. The aperture receives a closure or stopper 15 that may be a resilient stopper or other type of closure well known in the art, such a threaded closure. A perimeter flange 22 adjacent the first face 13 is dimensioned to rest upon the frame member 9 to support the one or more flasks with the second face 16 forming the top margin of the cooled storage area 8. The greater thickness of the flask projects below the frame member, so that the cover may be closed while the flasks are in place. This provides cooling of the area 8 from above. In this case we provide three flasks. One flask may be removed or set atop one of the other flasks to provide access to the area 8 while still providing cooling from the top, as shown in FIG. 5. As shown in FIG. 6, apparatus 23 of the invention may be provided to retrofit an existing cooler.

In an experiment we have conducted with the cooled storage area 8 filled with wrapped sandwiches, the temperature of the sandwiches was maintained at or below 34 degrees Fahrenheit for a period of 30 hours with a single filling of ice cubes. Opening the insulated top to access the contents of the central cooled area 8 will result in less warming of the area 8, because cooling from the top continues. The insulating action of the contents of area 8 is less of a problem with this structure because the contents are being cooled from both top and bottom simultaneously.

As seen in FIG. 6, flexible transparent sheet panel 24, shown in phantom, may be employed to cover over the flasks and frame member 9 to enhance sealing.

While we have shown and described the preferred embodiments of our invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. Structure providing a storage area cooled by ice cubes above and below the storage area, the structure comprising:

a) an insulated open top body portion;

b) a removable perforated panel supported above the bottom of the body portion defining a bottom space below the panel for holding a plurality of ice cubes to cool the storage area from below, and keeping the storage area free from melting ice, while the water from the melted ice remains on the bottom of the body portion;

c) a removable frame member supported by the body portion above the storage area;

d) a large central aperture in the frame member;

e) at least one flask having two broad opposed faces and a closable aperture in one of the broad faces dimensioned to readily receive therethrough a plurality of ice cubes;

f) a flange around the perimeter of the flask constructed to support the flask in the aperture with the other of the broad faces forming the top margin of the storage area while cooling the storage area from above; and g) an insulated closure constructed to securely close the open top while the at least one flask is in place on the frame.

2. The structure of claim 1 further comprising a flexible transparent panel dimensioned to overlie the at least one flask and seal the space below the closure.

3. Apparatus to be inserted into a portable insulated cooler having an open top body portion and an insulated hinged closure to provide a storage area cooled by ice cubes above and below the storage area, the apparatus comprising:

a) a removable perforated panel supported above the bottom of the body portion defining a bottom space below the panel for holding a plurality of ice cubes to cool the storage area from below, and keeping the storage area free from melting ice, while the water from the melting ice remains at the bottom of the body portion;

b) a removable frame member supported by the body portion above the storage area;

c) a large central aperture in the frame member;

d) at least one flask having two broad opposed faces and a closable aperture in one of the broad faces dimensioned to readily receive therethrough a plurality of ice cubes; and e) a flange around the perimeter of the flask constructed to support the flask in the aperture with the other of the broad faces forming the top margin of the storage area while cooling the storage area from above.

4. The apparatus of claim 3 further comprising a flexible transparent panel dimensioned to overlie the at least one flask and seal the space below the closure.

* * * * *